US006012266A

United States Patent [19]

Koskinen et al.

[11] Patent Number: 6,012,266

[45] Date of Patent: Jan. 11, 2000

[54] METHOD FOR PACKING BULK GOODS AND A CONTAINER FOR BULK GOODS

[75] Inventors: Erkki Koskinen, Pori, Finland; Tom Stenmark, Waterloo, Belgium

[73] Assignee: UPM-Kymmene Oy, Helsinki, Finland

[21] Appl. No.: 09/019,872

[22] Filed: Feb. 6, 1998

Related U.S. Application Data

[63] Continuation-in-part of application No. 08/685,478, Jul. 24, 1996, which is a continuation-in-part of application No. 08/302,668, Oct. 25, 1994, Pat. No. 5,544,472.

[30] Foreign Application Priority Data

| | | | |
|---|---|---|---|
| Mar. 10, 1992 | [FI] | Finland | 921043 |
| Dec. 7, 1992 | [FI] | Finland | 925555 |

[51] Int. Cl.[7] ..... B65B 13/02

[52] U.S. Cl. ..... 53/399; 53/441; 53/442; 53/449

[58] Field of Search ..... 383/119; 53/399, 53/449, 441, 442, 173, 576, 578, 579

[56] References Cited

U.S. PATENT DOCUMENTS

| | | | |
|---|---|---|---|
| 2,973,119 | 2/1961 | Parker | 222/131 |
| 3,529,717 | 9/1970 | McDougal | 206/65 |
| 3,670,880 | 6/1972 | Burleson et al. | 53/449 |
| 3,858,526 | 1/1975 | Lombard et al. | 206/386 |
| 3,949,901 | 4/1976 | Tokita | 222/94 |
| 4,154,045 | 5/1979 | Christenson | 53/432 |
| 4,172,152 | 10/1979 | Carlisle | 426/127 |
| 4,215,520 | 8/1980 | Heinzer et al. | 53/173 |
| 4,253,507 | 3/1981 | Williamson | 383/119 |
| 4,546,593 | 10/1985 | Lasscock | 53/441 |
| 4,597,189 | 7/1986 | Cutrara | 34/38 |
| 4,698,951 | 10/1987 | Everman et al. | 53/449 |
| 4,834,255 | 5/1989 | Boots | 229/41 R |
| 4,879,861 | 11/1989 | McAdams | 53/435 |
| 4,901,885 | 2/1990 | Boots | 220/402 |
| 4,903,859 | 2/1990 | Derby et al. | 383/119 |
| 5,005,335 | 4/1991 | Yourgalite et al. | 53/399 |
| 5,016,761 | 5/1991 | Stoddard et al. | 206/597 |
| 5,025,925 | 6/1991 | Wiklund | 206/386 |
| 5,071,025 | 12/1991 | Boots | 220/410 |
| 5,230,689 | 7/1993 | Derby | 493/89 |
| 5,316,387 | 5/1994 | Polett | 383/119 |
| 5,328,268 | 7/1994 | Lafleur | 383/119 |
| 5,354,569 | 10/1994 | Brown et al. | 426/411 |
| 5,468,528 | 11/1995 | Schnaars et al. | 383/119 |
| 5,538,155 | 7/1996 | Hoekstra | 383/119 |
| 5,664,887 | 9/1997 | LaFleur | 383/119 |

FOREIGN PATENT DOCUMENTS

| | | | |
|---|---|---|---|
| 0122864 | 10/1984 | European Pat. Off. . | |
| 0180379 | 5/1986 | European Pat. Off. . | |
| 0338181 | 10/1989 | European Pat. Off. . | |
| 0276878 | 10/1990 | European Pat. Off. | B65D 5/44 |
| 0401934 | 12/1990 | European Pat. Off. | B65D 5/44 |
| 3453171 | 12/1971 | Finland . | |
| 45143 | 3/1972 | Finland . | |
| 773460 | 5/1978 | Finland . | |
| 57382 | 4/1980 | Finland | B65D 90/08 |
| 61174 | 2/1982 | Finland | B65D 88/16 |
| 68590 | 6/1985 | Finland | B65D 88/16 |
| 2634469 | 1/1990 | France | 383/119 |
| 8900271A | 9/1990 | Netherlands | 383/119 |
| 159990 | 4/1981 | Norway . | |
| 467195 | 7/1967 | Switzerland . | |
| 2184422 | 6/1987 | United Kingdom | 383/119 |
| 9317911 | 9/1993 | WIPO | B65B 1/00 |

*Primary Examiner*—Eugene L. Kim
*Attorney, Agent, or Firm*—Steinberg & Raskin, P.C.

[57] ABSTRACT

A method for packaging bulk goods into an intermediate bulk container including the steps of placing an inner package made of a flexible resilient material onto a base, providing the inner package with a reinforcement structure in an interior thereof, filling the interior of the inner package with bulk goods whereby the inner package obtains substantially the shape of a parallelepiped, and then surrounding the inner package and at least a portion of the base with an outer package made of a plastic material to firmly secure the inner package to the base via the outer package.

15 Claims, 2 Drawing Sheets

Fig. 1
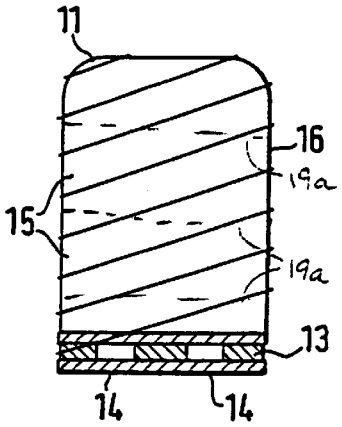
Fig. 2
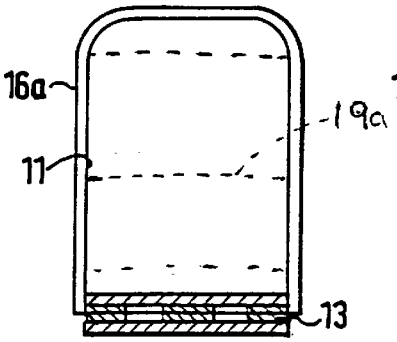
Fig. 3
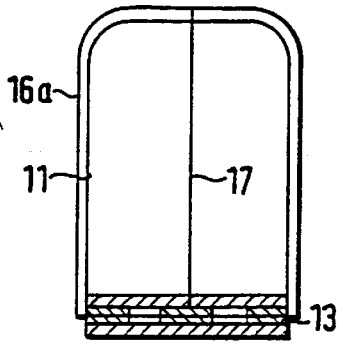
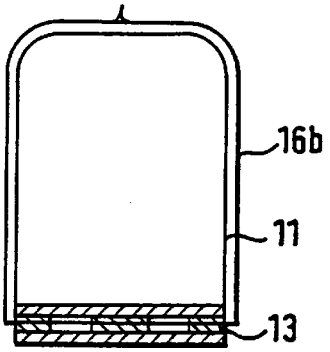
Fig. 4
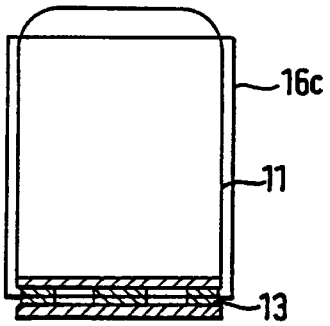
Fig. 5

FILING
+VACUUM

METHOD FOR PACKING BULK GOODS AND A CONTAINER FOR BULK GOODS

CROSS-REFERENCE TO RELATED APPLICATIONS

This application is a continuation-in-part of U.S. patent application Ser. No. 08/685,478 filed Jul. 24, 1996 which in turn is a continuation-in-part of U.S. patent application Ser. No. 08/302,668 filed Oct. 25, 1994, now U.S. Pat. No. 5,544,472.

FIELD OF THE INVENTION

The present invention relates generally to methods for packaging bulk goods into a unit-load package, and more particularly to methods for packaging bulk goods into an unit-load package comprising an inner package and an outer package surrounding the inner package, as well as the unit-load package itself A unit-load package or sack for bulk goods is commonly referred to in the art as a flexible intermediate bulk container (FIBC).

BACKGROUND OF THE INVENTION

For packaging, storage, and transportation of bulk goods, box packages or other packages of rigid construction are used, which are placed on a base (usually a pallet). The box packages consist of boxes of corrugated board. A box of corrugated board is, as a rule, provided with an inner sack into which the bulk goods are placed. When filled with the bulk goods, such a package has a quadrangular shape, i.e., the shape of the paperboard box, and thus utilizes the transportation base maximally, even though the package as such is expensive.

Unit-load sacks are also used for packaging, storage, and transportation of bulk goods. A unit-load sack is less expensive than a box package, but its drawback is its round shape when filled, whereby it utilizes the transportation base less efficiently than a box package does. It is understood in the art that bulk goods do not have a specific shape in bulk, such as grains, fertilizers and other granular materials. Thus, unit-load sacks bulge when filled and do not retain any definite shape.

In prior art related to the invention, U.S. Pat. No. 3,670,880 (Burleson et al.) shows an arrangement wherein paperboard receptacles are filled with flexible products and then a stack of the paperboard receptacles is surrounded by a heat-shrinkable plastic outer covering. The paperboard receptacle is made of a multilayer corrugated board and protects the flexible products from moisture. More particularly, Burleson et al. shows a package construction including a receptacle having a flat bottom and sidewalls extending upward from the flat bottom. The flexible products are placed in the receptacle to extend over a top edge thereof. A closure is placed on the products and has downwardly extending peripheral sidewalls which overlap a portion of the sidewalls of the receptacle. The closure and the receptacle are made from multilayer corrugated board and in view of the overlap of the closure about the receptacle, the products are isolated from the ambient atmosphere. To seal the closure to the receptacle and thus the products within a housing of corrugated board, a plastic film outer layer is shrunk wrapped about the closure and the receptacle.

U.S. Pat. No. 5,005,335 (Yourgalite et al.) shows a stretch wrapping operation wherein there are two layers that are tightly wrapped around the articles through a banding process.

U.S. Pat. No. 4,968,951 (Everman et al.) shows a method in which an inner sack is formed from a reel of inner sack blanks, placed inside a paperboard box, filled when it is in the paperboard box and the both the inner sack and the paper board box are closed. By retaining the inner sack in the rigid paperboard box, the inner sack does not bulge upon its filling with the bulk goods.

Netherlands Patent No. 8900-271 describes a "large sack" or container which is typically prepared from woven material, e.g., polypropene fabric, and is provided with lifting loops at its corners to enable the container to be lifted vertically from its top. In this container, there are no discrete "inner" and "outer" packages but rather, there is but a single package which constitutes both the "inner" package in contact with the bulk goods in the interior and "outer" package which is exposed. Thus, this container is ready for use, i.e., it can be filled with bulk material and transported without additional components. The inner side of the package is provided with stiffening elements connecting adjacent sides, whereby when filled, the container obtains an essentially parallelepiped shape.

In view of the fact that the container of Netherlands '271 is lifted from its top, the material from which the container is made is required to be sufficiently strong to avoid collapsing upon the container being lifted in its intended manner. Thus, an appropriate safety factor of such a container would be 5:1 to 8:1. However, the requirement for a sufficient strength of the container limits the materials from which the container may be made. Specifically, the container should be made of a strong woven material in order to provide the necessary structural integrity and strength to enable the container to be lifted by means of the lifting loops. To make the container out of strong woven material, it is necessary to sew the seams of different pieces of woven material together to obtain the final form of the container. It is not possible to heat seal the seams together because heat sealing plastic fibers in the woven material, which are initially heat sealed and stretched to orient the molecules to provide strength, would cause the strengthening process to reverse itself and the woven material to lose its strength.

OBJECTS AND SUMMARY OF THE INVENTION

It is an object of the present invention to provide a method for packaging of bulk goods into a resilient package which, when filled, obtains a substantially quadrangular or parallelepiped shape and in which, as the base, it is possible to use standard pallets (e.g. EUR, FIN pallets). In this way, it is possible to combine the maximal utilization of space by a box package with the favorable cost of a resilient package. At the same time, the recycling of the used package can be arranged better, because no sorting of different materials is required, but the resilient package is recycled as such, and the standard pallet is returned to circulation. In the case of a box package constituted by different materials, it is necessary to separate the box, the inner sack, and the base, and the recycling must be arranged through three separate systems.

A further object of the present invention is to provide a method for packaging bulk goods into a resilient package whose inner friction is very low.

Another object of the invention is to provide a new and improved method for packaging bulk goods into an intermediate flexible bulk container.

Still another object of the present invention is to provide a new and improved method for packaging bulk goods into an intermediate bulk container which is formed from a single type of material, e.g., plastic, to enable easy recycling of the container after use.

Another object of the present invention is to provide a new and improved method for packaging bulk goods in which an inner package containing the bulk goods is firmly held in place on a base to enable secure transport of the inner package.

It is yet another object of the present invention to provide a new and improved intermediate bulk container which includes a base on which an inner package containing bulk goods is placed and which enables the bulk container to be lifted from below via the base, thereby avoiding the use of lifting loops arranged at a top of the bulk container for enabling the bulk container to be lifted from its top.

The method in accordance with the invention for packaging of bulk goods into a unit-load package or flexible intermediate bulk container is characterized in that:

(a) an inner package made of a resilient material is placed on a base, (b) the inner package is provided with a reinforcement structure separate from the inner package or integral therewith, (c) the inner package is filled with bulk goods, whereby, during the filling, the inner package obtains substantially a form of a definite shape, such as a parallelepiped, as a result of the presence of the reinforcement structure in the interior of the inner package, and (d) the inner package and at least a portion of the base are surrounded with an outer package of plastic material, whereby a stable transportation package is formed.

The flexible intermediate bulk container produced by the method in accordance with the invention is characterized in that the inner package is an inner sack made of a flexible material, preferably plastic film, and provided with a reinforcement structure, which sack has been placed on a base for the time of filling with bulk goods, preferably by suspending or supporting it above the base and that the outer package is an outer package which is made of a plastic material and which surrounds the inner package tightly and gives it adequate stability.

Whether the reinforcement structure is separate from or integral with the inner package, it is situated in the interior of the inner package and serves to support the inner package upon filling of the inner package with bulk goods, which have no specific shape, to thereby form an upright structure. For example, the inner package is most often provided with a parallelepiped shape upon filling. The reinforcement structure is designed to prevent the inner package from bulging outward upon filling with the bulk goods. More particularly, the reinforcement structure can be designed to connect at least opposed inner faces of the sides of the inner package to prevent movement of one side relative to the opposite side and thus prevent bulging of the inner package upon filling with bulk goods.

In the method of the invention, it has been realized to use a unit-load package, i.e., a flexible intermediate bulk container, which comprises an inner package made of a flexible inexpensive material and a surrounding outer package, which gives the unit-load package adequate robustness during use and transport. As the flexible material of the inner package whose rigidity is relatively low, for example, plastic films, paper, or light weight synthetic fabrics can be used. For the time of the filling with bulk goods, the resilient package is suspended or supported above a suitable base, such as a pallet. After the filling with bulk goods, the inner package, which is provided with an appropriate reinforcement structure, is bound to the base, e.g., by means of a tightening foil so that a robust unit, i.e., a unit-load package or intermediate bulk container, is formed. The width of the tightening foil is not an essential factor. The width of the tightening foil may be a conventional width, such as about 500 mm, but, as the tightening foil, it is also possible to use even a full-width tightening foil of a width equal to the height of the entire inner package. Instead of a tightening foil, it is, of course, also possible to use a tightening hood or a shrinking hood.

As noted above, the reinforcement structure may be a separate reinforcement structure connected to specific portions of the inner package, e.g., interior faces of the sides of the inner package, or a part of the inner package may operate as a reinforcement structure at the same time, i.e., an integral or unitary formation of an inner package having a reinforcement structure.

It is a characteristic of the intermediate bulk container or unit-load package in accordance with the invention that the inner package of the unit-load package must endure the strains imposed during the filling stage and that the measure of the circumference of the inner package filled with bulk goods should not increase substantially during the filling stage. It should be noticed that, during the filling, the inner package may become somewhat wider, i.e., change its shape and receive a quadrangular shape, which can then later be easily wrapped into a tightening foil so as to produce the ultimate unit-load package.

The unit-load package in accordance with the invention permits easy and convenient recycling of used resilient package materials. Moreover, after emptying of the unit-load package, the pallet used for the unit-load package can be stored and re-used.

A unit-load package produced by the method in accordance with the invention that is filled with bulk goods is a sufficiently robust and operable unit, which also tolerates storage and transportation very well. The unit-load package in accordance with the invention can be lifted easily, e.g., in connection with storage by lifting the unit-load package by means of the forks of a fork-lift truck by using the openings in the pallet.

The inner package, the outer package, and the load base form a unit which can be stacked easily and which is not deformed substantially during stacking and storage.

Even though during packaging of bulk goods of very low inner friction, the inner package itself obtains the shape of a parallelepiped because of its reinforcement structure provided in the interior of the inner package, the stability of the inner package alone often remains inadequate in view of the subsequent step, the surrounding of the inner package with the outer package of plastic material, and therefore the handling properties of the ultimate package, such as stacking quality and stability, do not always become optimal.

In a preferred embodiment of the invention, the inner package is subjected to negative pressure after the filling and before the inner package is closed. In such a case, the inner package is pressed tightly around the bulk goods, and therefore the stability of the inner package is increased and subsequent processing/transport steps can be carried out readily.

When the inner package has been surrounded with plastic material, which is placed tightly against the inner package, a stable transportation package has been obtained. The stability of the unit-load package then remains good even if the negative pressure produced into the inner package were lost in the course of time. In such a case, at least the following concrete advantages are obtained in comparison with the prior art vacuum packages.

1. For the inner package, it is possible to use normal polyolefin plastics, such as polyethylenes, and it is not necessary to use expensive barrier plastics, whose recycling is, moreover, difficult. This stems from the fact that the inner package is not exposed to the environment but rather is protected by the outer package.

2. If a small hole is produced into the inner package during transportation and handling, the stability of the unit-load package is not deteriorated thereby, because the plastic material that surrounds the inner package, preferably a pre-stressed tightening foil, provides the necessary stability. Thus, it has been found that a puncture of both the outer and inner packages, such as by a forklift, does not result in the complete collapse of the intermediate bulk container. Rather, the container is self-sealing to some extent in view of the wrapping of the outer package about the inner package.

In an embodiment of the method of the invention, it is possible to use a separate outside formwork construction. In such a case, it is advantageous that the separate outside formwork construction is of the same measures as the transport base, because, then, the inner package fully complies with the measures of the transport base.

It is one of the most remarkable advantages of the present invention that the unit-load package in accordance with the invention can be manufactured out of a quantity of material that is substantially less than the material of a conventional unit-load sack because the lifting capacity required by the safety coefficient is not needed, which is the case with unit-load sacks provided with lifting loops. Other advantages are that the utilization of an inner package made of a flexible resilient material enables the package to endure the strains imposed by the filling stage of the method while importing stability thereafter. The use of such a material allows the package to be filled with bulk goods of a rigid nature as the inner package, with the aid of the reinforcement structure, will subsequently take the form of a parallelepiped. The outer package, formed of a plastic material, provides the combination with stability during transportation and storage.

In one embodiment of the method in accordance with the invention, the inner package is formed integral with the reinforcement structure whereby the reinforcement structure is made of the same resilient material as the inner package. Alternatively, the reinforcement structure can be formed separate from the inner package, and then attached at least to opposed interior faces of the inner package such that uncontrolled bulging of the inner package upon filling of the inner package with bulk goods is prevented. In the event that the inner package has four sides, the reinforcement structure is preferably connected to an interior face of all of the four sides and does not extend across the entire lateral area of the inner package so as to allow the flow of the bulk goods therethrough into the interior of the inner package during filling thereof.

BRIEF DESCRIPTION OF THE DRAWINGS

The following drawings are illustrative of embodiments of the invention and are not meant to limit the scope of the invention as encompassed by the claims.

FIG. 1 is a schematic side view of a first preferred embodiment of a unit-load package produced by the method of the invention.

FIG. 2 is a schematic side view of a second preferred embodiment of a unit-load package produced by the method of the invention.

FIG. 3 is a schematic side view of a third preferred embodiment of a unit-load package produced by the method of the invention.

FIG. 4 is a schematic side view of a fourth preferred embodiment of a unit-load package produced by the method of the invention.

FIG. 5 is a schematic side view of a fifth preferred embodiment of a unit-load package produced by the method of the invention.

DETAILED DESCRIPTION OF THE PREFERRED EMBODIMENTS

Figure 6:
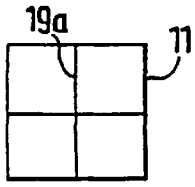
FIG. 6 is a top view of a first preferred embodiment of the reinforcement structure in the inner package of a unit-load package in accordance with the invention.

Referring to the accompanying drawings wherein the same reference numerals refer to the same or similar elements, in the embodiment shown in FIG. 1, an inner package 11 is placed on a suitable base, such as a pallet 13. The lifting openings provided in the pallet 13 are denoted by reference numeral 14. The inner package 11 is usually shipped in a deflated condition, for space considerations, and then expanded when it is the loading/filling position suspended on or supported by the pallet 13. A reinforcement structure 19*a* is arranged in an interior of the inner package, e.g., it is formed integral therewith, and does not extend across the entire lateral area of the interior of the inner package 14 to avoid interrupting the flow of bulk goods into the entire interior of the inner package 11 (See FIG. 6). The reinforcement structure 19*a* connects opposed interior faces of the sides of the inner package 11. The inner package 11 is then filled with bulk goods, such as a granular material, but the inner package 11 does not bulge because it retains its shape in view of the interior placement and arrangement of the reinforcement structure 19*a*. Thereafter, the inner package 11 filled with bulk goods is surrounded by winding a tightening-foil band 15 around it as well as at least a portion of the pallet 13. In this way, the outer package 16 is formed, which surrounds the inner package 11 and the pallet 13, and gives the unit-load package adequate stability. Although reinforcement structure 19*a* is shown in detail in FIG. 6, any of the reinforcement structures shown in FIGS. 7–13 can be placed in the interior of the inner package 11.

The unit-load package in accordance with the invention is designed to be lifted by appropriate means from below, i.e., by means of the base or pallet 13 on which the inner package 11 is placed. The inner package 11 expressly does not include any lifting loops, which are attached to the top of prior art bulk containers to enable the bulk containers to be lifted from its top. Indeed, it is possible that the outer package 16 would cover the entire surface of the inner package so that it would not be possible to even place lifting loops on the inner package 11. Also, it should be noted that if the inner package 11 were to be made of a plastic film material, as in a preferred embodiment, then such an inner package 11 would not likely have sufficient strength to be able to lifted by means of lifting loops.

The embodiment shown in FIG. 2 differs from the embodiment of FIG. 1 in the respect that, in the embodiment of FIG. 2, the inner package 11 is surrounded by a full-width tightening foil 16*a*.

The embodiment shown in FIG. 3 is in the other respects the same as that shown in FIG. 2, except that, in the embodiment of FIG. 3, the full-width tightening foil 16*a* is provided with a seam 17.

In the embodiment shown in FIG. 4, the inner package 11 filled with bulk goods is surrounded by a tightening or shrink hood 16*b*, which constitutes the outer package of the unit-load package.

In the embodiment shown in FIG. 5, the inner package 11 filled with bulk goods is surrounded by a so-called tightening or shrink sock 16*c*, which constitutes the outer package of the unit-load package.

The placement of the outer package 16 around the inner package 11 and at least a portion of the pallet 13, which may be provided in all of the disclosed embodiments, provides significant advantages which have not been obtained in the past. Specifically, in view of the fact that the inner package 11 is not exposed to the elements, it may be made of a less costlier plastic material, and further the layering of the outer package 16 about the inner package 11 forms a tightly sealed package which is not easily punctured, and even if punctured, does not cause the complete collapse of the inner package. Also, the outer package 16 can be formed so as to overlie at least a portion of the pallet 13 thereby firmly securing the inner package 11 to the pallet 13. This forms a structure in which the inner package is securely retained in a fixed position on and in connection with to the pallet 13.

Figure 7:
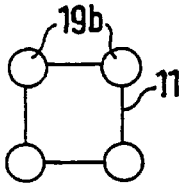
FIG. 7 is a top view of a second preferred embodiment of the reinforcement structure in the inner package of a unit-load package of the invention.
Figure 8:
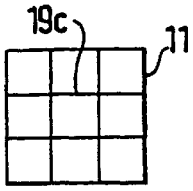
FIG. 8 is a top view of a third preferred embodiment of the reinforcement structure in the inner package of a unit-load package of the invention.
Figure 9:
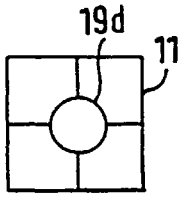
FIG. 9 is a top view of a fourth preferred embodiment of the reinforcement structure in the inner package of a unit-load package of the invention.
Figure 10:
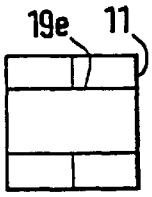
FIG. 10 is a top view of a fifth preferred embodiment of the reinforcement structure in the inner package of a unit-load package of the invention.
Figure 11:
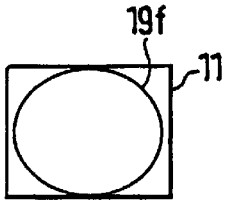
FIG. 11 is a top view of a sixth preferred embodiment of the reinforcement structure in the inner package of a unit-load package of the invention.
Figure 12:
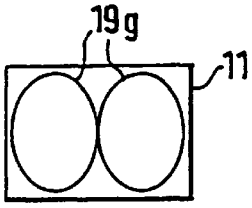
FIG. 12 is a top view of a seventh preferred embodiment of the reinforcement structure in the inner package of a unit-load package of the invention.
Figure 13:
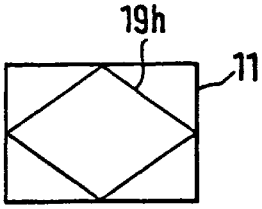
FIG. 13 is a top view of an eighth preferred embodiment of the reinforcement structure in the inner package of a unit-load package of the invention.

In the unit-load package in accordance with the invention, a separate reinforcement structure may be used. The reinforcement structure is arranged, in relation to the inner package 11, in the ways shown, e.g., in FIGS. 6–13, in the interior of the inner package 11. In the embodiment shown in FIG. 6, the inner package 11 is provided with a cross-shaped reinforcement structure 19*a* which connects inner faces of opposed sides of the inner package. In the embodiment of FIG. 7, there are tubular reinforcement structures 19*b* at the corners of the inner package 11 and which are connected to the sides of the inner package 11. In the embodiment of FIG. 8, the inner package 11 is provided with a net-shaped reinforcement structure 19*c*. In the embodiment of FIG. 9, the inner package 11 is provided with a tubular reinforcement structure 19*d*, which is placed substantially in the middle area and which is supported on the walls of the inner package 11. In the embodiment of FIG. 10, the inner package 11 is provided with a rectangular reinforcement structure 19*e*, which is supported on the inner package 11 from two of its opposite sides. In the embodiment of FIG. 11, the inner package 11 is provided with a substantially circular reinforcement structure 19*f*. In the embodiment of FIG. 12, the inner package 11 is provided with two substantially circular reinforcement structures 19*g* connected to the adjoining inner faces of the sides of the inner package 11. In the embodiment of FIG. 13, the inner package 11 is provided with a reinforcement structure 19*h* shaped as a rhomb. The shape of the reinforcement structure is not critical. What is essential is that the reinforcement structure is coupled to the inner package 11 and should help the inner package 11 retain an upright form, e.g., so that it has a shape substantially similar to a parallelepiped upon its filling with bulk goods.

In the method in accordance with the invention for packaging of bulk goods into a unit-load package, the inner package 11, which is made of a resilient material and which is provided with a reinforcement structure 19*a*, 19*b*, 19*c*, 19*d*, 19*e*, 19*f*, 19*g*, or 19*h* in its interior, is placed on a base 13. The inner package 11 is preferably made of plastic film. The inner package 11 is filled with bulk goods, whereby, during the filling, the inner package 11 obtains substantially the shape of a parallelepiped. The inner package 11 and at least a portion of the base 13 are surrounded with an outer package 16, 16*a*, 16*b*, or 16*c* of plastic material, whereby a stable transportation package is formed. According to one embodiment of the invention, the inner package 11 filled with bulk goods is subjected to negative pressure, whereby the inner package 11 is pressed tightly around the bulk goods. Whereupon, the inner package 11, which has been filled with bulk goods and subjected to negative pressure, is surrounded with an outer package 16 made of plastic material, preferably the plastic film. The outer package 16 thus surrounds the entire inner package 11.

One of the advantages of the invention is that the wrapping of the outer package 16 around the base or pallet 13 incorporates the means by which the bulk container will be lifted from below into the bulk container. Thus, the base on which the inner package is placed forms a part of the bulk container and is enclosed within the outer package 16.

Figure 14A:
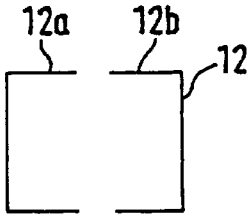
FIGS. 14A, 14B, 14C, 14D, 14E, 14F and 14G are schematic illustrations viewed from above of the various steps in one embodiment of the method of the invention.
Figure 14B:
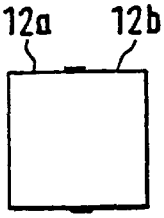
Figure 14C:
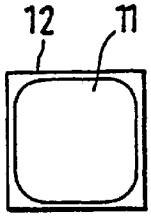
Figure 14D:
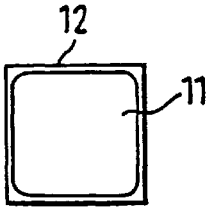
Figure 14E:
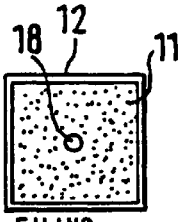
Figure 14F:
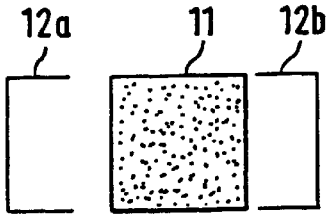
Figure 14G:
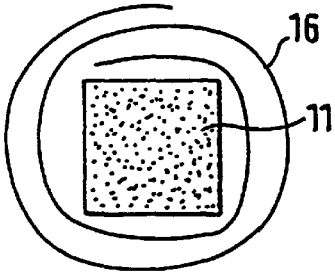

In the embodiment illustrated in FIGS. 14A–14G, the formwork construction used in the method of the invention is denoted generally with the reference numeral 12. The positioning of the inner package 11 with respect to the base 13 has been achieved by means of the formwork construction 12. In this embodiment, the formwork construction 12 consists of formwork halves 12*a* and 12*b*. In the situation as shown in FIG. 14A, the substantially U-section formwork halves 12*a* and 12*b* are separate from one another. In the next step of the method, the formwork halves 12*a* and 12*b* are displaced towards one another so that they form a formwork construction 12 shaped as a parallelepiped. In the method stage as shown in FIG. 14C, the inner sack 11 is placed into the formwork construction 12 (the reinforcement structure in the sack is not shown). FIG. 14D illustrates the process step in which the inner sack 11 is filled with bulk goods, whereby the inner sack 11 receives a substantially quadrangular shape inside the formwork construction 12. In the stage of the method illustrated in FIG. 14E, the inner sack 11 filled with bulk goods is subjected to negative pressure. In this embodiment, the inner sack 11 communicates with a source of negative pressure, which is not shown through a tubular duct 18. In the stage of the method shown in FIG. 14F, the formwork halves 12*a* and 12*b* of the formwork construction 12 are shifted apart from one another, whereby the inner sack 11, which has been filled with bulk goods and subjected to negative pressure, retains its substantially quadrangular shape. In the stage of the method shown in FIG. 14G, the formwork construction 12 has been removed completely, and the inner sack 11, filled the bulk goods and subjected to negative pressure, is surrounded with the outer package 16 of plastic material, whereby a stable transportation package is formed.

Thus, in a general embodiment of the method of the invention, a separate formwork construction is not needed necessarily, because the inner package 11 can be placed onto the base 13, e.g., by suspending. If desired, it is possible to use a separate outside formwork construction 12 in the method of the invention, as is shown in the embodiment illustrated in FIGS. 14A–14G. In such a case, it is preferable that the separate outside formwork construction 12 is of the same size as the transport base 13, because then the inner package 11 complies precisely with the measures of the transport base 13.

Figure 15:
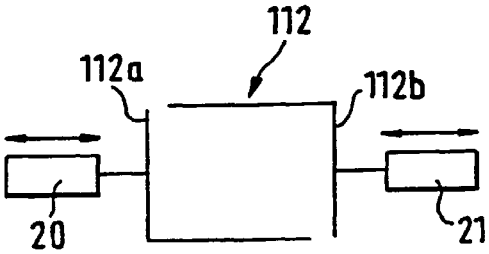
FIG. 15 is a schematic top view of a second preferred embodiment of the formwork employed in the method as illustrated in FIGS. 14A–14G.

The formwork construction illustrated in the embodiment of FIG. 15 is denoted generally with the reference numeral 112. The formwork construction 112 consists of substantially L-section formwork halves 112*a* and 112*b*. A pneumatic cylinder 20 is fitted to displace the formwork half 112*a*, and a pneumatic cylinder 21 is fitted to displace the formwork half 112*b*, respectively.

The examples provided above are not meant to be exclusive. Many other variations of the present invention would be obvious to those skilled in the art, and are contemplated to be within the scope of the appended claims.

We claim:

1. Method for packaging bulk goods into an intermediate bulk container, comprising the steps of:

forming an inner package with an integral reinforcement structure to provide said inner package with a substantially parallelepiped shape upon filling with bulk goods, said inner package being made of a non-self-supporting, flexible resilient material and said reinforcement structure being made of a non-self-supporting material, forming a base comprising means for supporting an inner package filled with bulk goods from below, placing said inner package on said base, filling the interior of said inner package with bulk goods whereby said inner package obtains the parallelepiped shape, and surrounding said parallelepiped-shaped, filled inner package and at least a portion of said base with an outer package by winding a tightening-foil band made of a plastic material around said inner package and said base such that said inner package and said base are firmly attached to one another with said outer package to form a stable transportation package.

2. The method of claim 1, wherein said inner package is made of plastic film.

3. The method of claim 1, wherein said inner package does not include lifting loops.

4. The method of claim 1, further comprising the step of arranging said reinforcement structure in an interior of said inner package.

5. The method of claim 1, further comprising the step of subjecting said inner package to a negative pressure after said inner package has been filled with bulk goods such that said inner package is pressed tightly around said bulk goods.

6. The method of claim 1, wherein the step of surrounding said parallelepiped-shaped, filled inner package and at least a portion of said base with an outer package comprises the step of surrounding said outer package with a full-width tightening foil.

7. The method of claim 1, wherein the step of surrounding said parallelepiped-shaped, filled inner package and at least a portion of said base with an outer package comprises the step of surrounding said outer package with a full-width tightening foil that is provided with a seam.

8. The method of claim 1, wherein the step of surrounding said parallelepiped-shaped, filled inner package and at least a portion of said base with an outer package comprises the step of surrounding said outer package with a tightening or shrink hood.

9. The method of claim 1, wherein the step of surrounding said parallelepiped-shaped, filled inner package and at least a portion of said base with an outer package comprises the step of surrounding said outer package with a tightening or shrink sock.

10. The method of claim 1, further comprising the step of forming said reinforcement structure from the same resilient material as said inner package.

11. The method of claim 1, further comprising the steps of forming said reinforcement structure separate from said inner package, and attaching said reinforcement structure to at least two distinct interior faces of said inner package such that bulging of said inner package upon said inner package being filled with bulk goods is prevented.

12. The method of claim 1, wherein said inner package has four sides, further comprising the steps of connecting said reinforcement structure to an interior face of all of said four sides, and forming said reinforcement structure such that it does not extend across the entire lateral area of an interior of said inner package so as to allow the flow of the bulk goods into the entire interior of said inner package.

13. The method of claim 1, further comprising the steps of forming said reinforcement structure separate from said inner package, and attaching said reinforcement structure to at least two opposed interior faces of said inner package such that bulging of said inner package upon said inner package being filled with bulk goods is prevented.

14. The method as in claim 1, wherein said step of forming said base comprises the step of forming a pallet.

15. The method as in claim 14, wherein said step of forming a pallet comprises the steps of forming a pallet having openings formed therein for lifting said pallet.

* * * * *